US006523551B1

(12) United States Patent
Brenkus et al.

(10) Patent No.: US 6,523,551 B1
(45) Date of Patent: Feb. 25, 2003

(54) APPARATUS AND METHOD FOR HOLDING DOWN BOTTLES IN A HIGH PRESSURE WASH

(75) Inventors: Frank M. Brenkus, Morgan Hill, CA (US); Craig B. Garrett, San Jose, CA (US)

(73) Assignee: Portola Packaging, Inc., San Jose, CA (US)

( * ) Notice: Subject to any disclaimer, the term of this patent is extended or adjusted under 35 U.S.C. 154(b) by 0 days.

(21) Appl. No.: 10/039,840

(22) Filed: Oct. 23, 2001

Related U.S. Application Data

(60) Continuation of application No. 09/447,841, filed on Nov. 23, 1999, now Pat. No. 6,321,761, which is a division of application No. 09/222,252, filed on Dec. 28, 1998, now Pat. No. 6,009,889.

(51) Int. Cl.[7] ..... B08B 3/02

(52) U.S. Cl. ..... 134/22.18; 134/25.5

(58) Field of Search ..... 134/170, 166 R, 134/169 R, 171, 199, 198, 168 R, 22.1, 22.18, 25.5, 25.1

(56) References Cited

U.S. PATENT DOCUMENTS

| | | | | |
|---|---|---|---|---|
| 910,882 | A | | 1/1909 | Truesdale |
| 1,114,066 | A | | 10/1914 | Templeton |
| 1,577,236 | A | | 3/1926 | Huss |
| 1,824,993 | A | | 9/1931 | Herold et al. |
| 2,140,589 | A | | 12/1938 | Lannmark |
| 2,599,455 | A | | 6/1952 | Huseman |
| 2,633,437 | A | | 3/1953 | Detjen |
| 2,655,929 | A | | 10/1953 | Herold |
| 3,262,460 | A | | 7/1966 | Huddle et al. |
| 3,291,143 | A | | 12/1966 | Huddle |
| 3,838,473 | A | | 10/1974 | Remih |
| 4,154,624 | A | | 5/1979 | Wahl et al. |
| 4,313,767 | A | | 2/1982 | Bemis et al. |
| 5,073,182 | A | | 12/1991 | Virey et al. |
| 5,135,014 | A | | 8/1992 | Beswick |
| 5,335,682 | A | * | 8/1994 | Yoshimura et al. |
| 5,348,033 | A | | 9/1994 | Levit |
| 5,356,481 | A | | 10/1994 | Yoshimura et al. |
| 5,363,866 | A | | 11/1994 | Egger |
| 5,373,618 | A | | 12/1994 | Doyle et al. |
| 5,409,545 | A | | 4/1995 | Levey et al. |
| 5,425,385 | A | | 6/1995 | Kuta et al. |
| 5,435,899 | A | * | 7/1995 | Gimenez et al. |
| 5,441,063 | A | | 8/1995 | Fernandez et al. |
| 5,507,060 | A | | 4/1996 | Quimpo |
| 5,598,859 | A | | 2/1997 | Kronseder |
| 5,706,842 | A | | 1/1998 | Caimi et al. |
| 5,885,401 | A | | 3/1999 | Eiban |
| 5,954,216 | A | * | 9/1999 | Meisner et al. |
| 6,003,529 | A | | 12/1999 | Perry, Jr. |

FOREIGN PATENT DOCUMENTS

| | | |
|---|---|---|
| JP | 10-277511 | * 10/1998 |

* cited by examiner

*Primary Examiner*—Frankie L. Stinson
(74) *Attorney, Agent, or Firm*—Dorsey & Whitney LLP

(57) ABSTRACT

A machine for washing bottles has a conveyor which advances intermittently from station to station. The conveyor has a carriage extending transversely thereof formed to receive at least one inverted bottle. Full cone spray nozzles located above and below the bottles as they pass along the conveyor spray warmed detergent solution on the exteriors of the bottles at each station. High pressure or solid stream jet nozzles at each stage project a jet of water from below into the inverted open mouth of each bottle at the stage to thoroughly clean the interior of each bottle. To counterbalance the forces of the jets below, which tend to lift the bottles off the conveyor, a jet of fluid from above impacts the inverted bottom of each bottle.

14 Claims, 4 Drawing Sheets

APPARATUS AND METHOD FOR HOLDING DOWN BOTTLES IN A HIGH PRESSURE WASH

This is a continuation of U.S. patent application Ser. No. 09/447,841, filed Nov. 23, 1999 now U.S. Pat. No. 6,321, 761, is a division of U.S. patent application Ser. No. 09/222, 252, filed Dec. 28, 1998 and now U.S. Pat. No. 6,009,889.

BACKGROUND OF THE INVENTION

1. Field of the Invention

This invention relates to a new and improved apparatus and method for washing bottles. More particularly, the invention relates to washing bottles returned to a bottling works for refilling wherein while traversing a main washing station, a jet of water directed to wash the inside of the inverted bottle tends to overcome the weight of the bottle and move the bottle off its carrier. In accordance with the present invention a counterbalancing jet of water is directed from the top toward the bottom of the inverted bottle to maintain the bottle on the conveyor.

2. Description of Related Art

Large containers such as 6 gallon, 5 gallon or 3 gallon and metric equivalent water bottles, preparatory to filling are washed, sanitized and rinsed. At multiple stations, the exteriors of the containers are sprayed with warmed cleaning solution while a pressure jet of the same solution is directed through the open neck of the inverted container into the interior. With increasing lighter weights of containers, including the shift from glass to plastic and to smaller containers, there has been a corresponding shift to lower impact pressures and flow rate, to prevent containers from being lifted off the conveyor. Although the lower impact and flow result in a reduced likelihood that containers will be lifted off the conveyor, they also reduce the effectiveness of the washing. Additionally, new containers with complex features such as handles are being introduced to the market, which make the current low impact and flow less effective. Mechanical clamps of various types have been unreliable and costly in solving the problem because of wide variations in the size, shoulder profile, neck profile and height of the containers.

The present invention differs from prior apparatus and methods for retaining the containers on the conveyor by directing a downward fluid on the inverted bottom of the container which counterbalances the upward force of the upward jet which is directed through the open neck of the container.

SUMMARY OF THE INVENTION

Although this invention may be used for other purposes, the following description will be limited to use in cleaning bottles. Preparatory to filling, returned empty bottles are passed through a washing process consisting of several stages. The apparatus involves use of a conveyor which is moved, preferably intermittently, through a loading stage where the bottles are loaded onto a conveyor either manually or mechanically. In the main wash stage, wash detergent solution heated by electric heaters or steam coils or by an external solution heater is pumped through nozzles. Multiple nozzles direct the spray outside each bottle. At each stage there is an upwardly directed jet of solution which passes through the neck of the bottle and cleans the interior. It has been found that the combination of high impact and flow rate creates a force which tends to overcome the weight of the bottle, causing it to lift off the conveyor. There are usually several wash stages within the main wash station.

At the next station a recirculated rinse is directed within the bottle and on the outsides thereof. Typically, the pressure at the rinse stage is not as great as the pressure at the main wash stage and hence a hold-down nozzle may not be necessary at the rinse stage. From the rinse stage the bottles pass to a sanitizing stage where ozonated water, chlorinated water or commercial sanitizing agents are used to sanitize the inside of the bottle. Following the sanitizing stage there is a final rinse stage where clean water is used inside the bottle to remove all residual materials, leaving the bottle completely clean and sanitized and ready for filling.

The present invention is an improvement over prior washing systems in that at the main wash stage a jet of fluid is directed downwardly against the inverted bottom of each bottle to counterbalance the upward force of the jet inserting water into the interior of the bottle and thereby preventing the bottle from being lifted off the holder. A similar downward jet may be used at other stages, as may be required.

BRIEF DESCRIPTION OF THE DRAWINGS

The accompanying drawings, which are incorporated in and form a part of this specification, illustrate embodiments of the invention and, together with the description serve to explain the principles of the invention.

DETAILED DESCRIPTION OF THE PREFERRED EMBODIMENT

Figure 1:
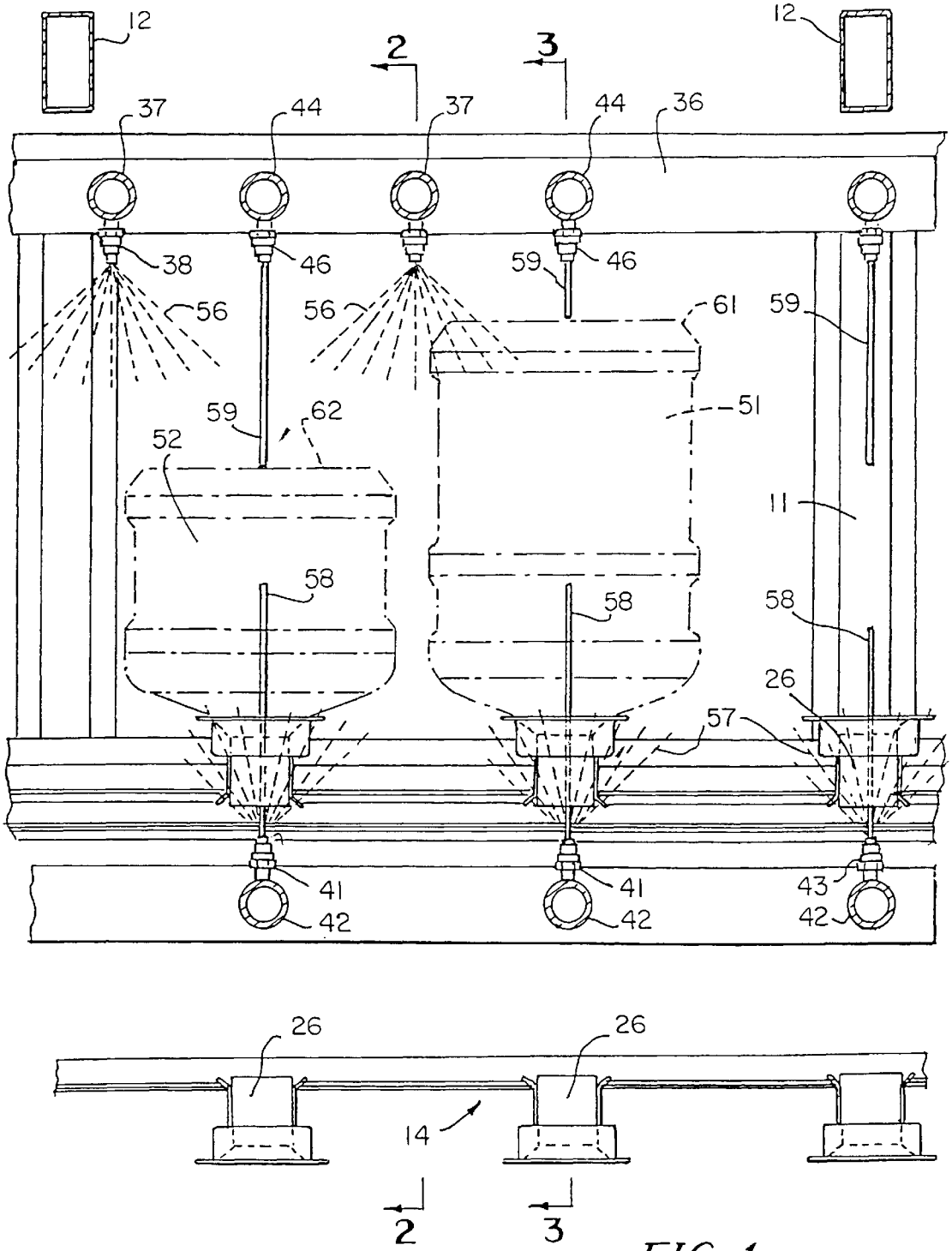
FIG. 1 is a schematic side elevational view of a portion of a main wash stage of a bottle cleaning operation.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

A preferred use of the present invention is to clean empty bottles such as a 5 gallon bottle 51 or a 3 gallon bottle 52. Each such bottle has a top shoulder 53 from which extends a neck 54. Bottle 51 has a bottom 61 and bottle 52 has a bottom 62. It will be understood that other containers and other articles may be cleaned or otherwise treated.

The apparatus is mounted on a frame consisting of vertical members 11, horizontal cross members 12 and horizontal longitudinal members 13, the construction of which is subject to wide variation. Preferably the front and back of the frame is mostly closed off with sides (not shown) which prevent the water within the system from spilling out into the room. Below the frame 11 is a tank (not shown) which collects the water after it has been sprayed on the bottles 51, 52. A pump (also not shown) pumps water out of the tank and into the apparatus hereinafter described.

Figure 6:
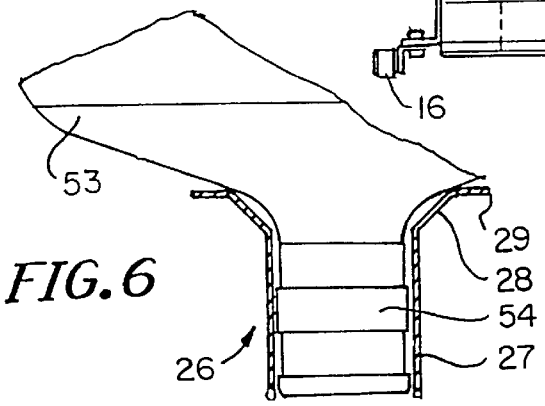
FIG. 6 is a further enlarged view of a holder which is mounted on the carrier (not shown) showing the neck of a bottle inserted therein.

On either side of the frame are chain drives 16 of any well-known type. Extending transversely of the chains 16 is a plurality of carriages 17. Each such carriage 17 has an end 18 from which depends and extends outwardly an ear 19 which is connected to a lug 20 on chain 16. Vertical sides 21 extend transversely of the direction of movement of chains 16. Mounted and affixed to surface 22 are holders 26 which are shaped to receive the necks 54 of bottles 51, 52. Thus each holder 26 has a cylindrical portion 27 in which the neck 54 fits. Above cylindrical portion 27 is a conical or outwardly-upwardly flared portion 28. A horizontally outwardly directed portion 29 is positioned at the top of the conical portion 28. As best shown in FIG. 6, the inverted bottle 51 or 52 is positioned so that its neck 54 is within the cylindrical portion 27 and that its shoulder 53 engages either the flange 29 or the conical portion 28.

Figure 2:
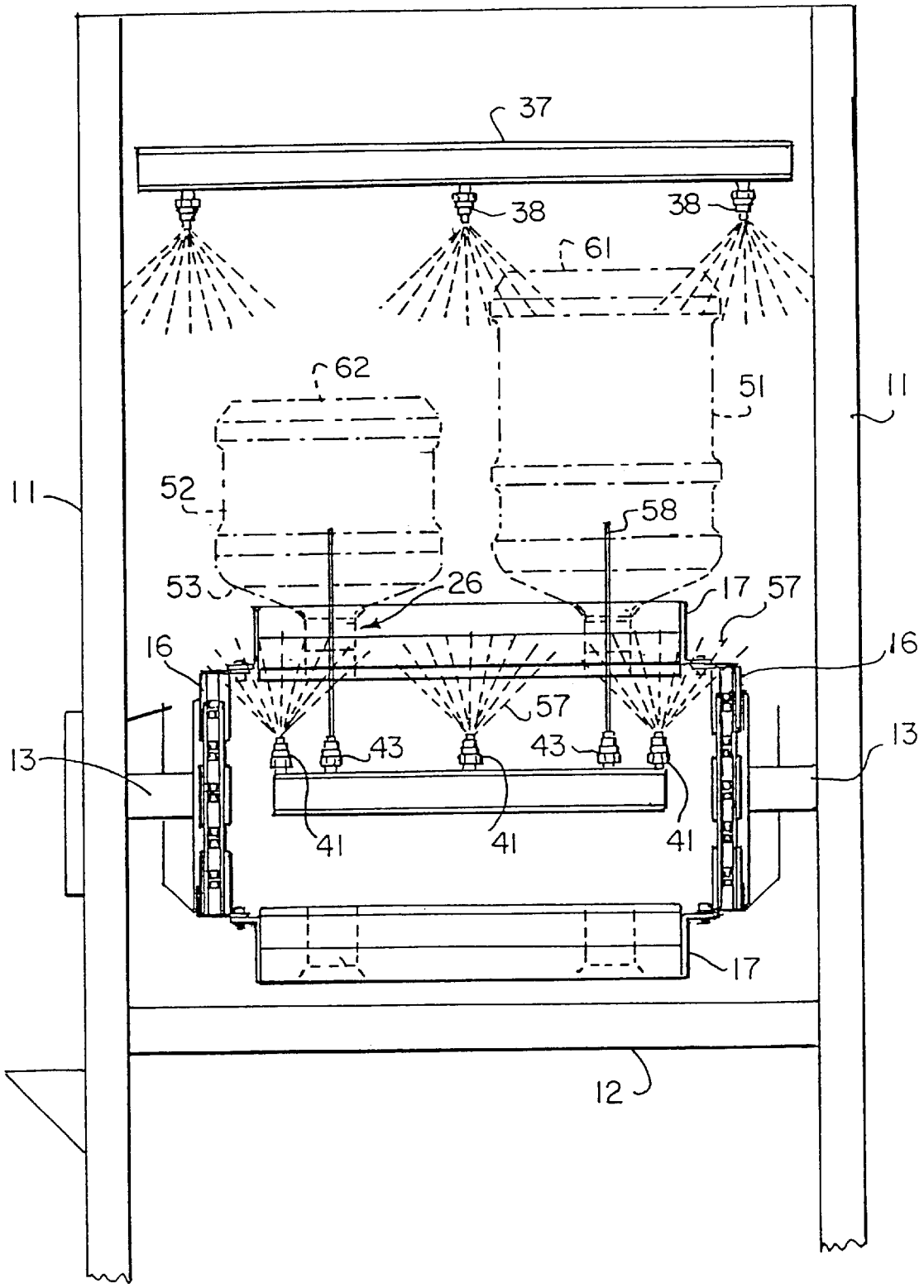
FIG. 2 is a sectional view taken substantially along the line 2—2 of FIG. 1, with certain items omitted for clarity.
Figure 3:
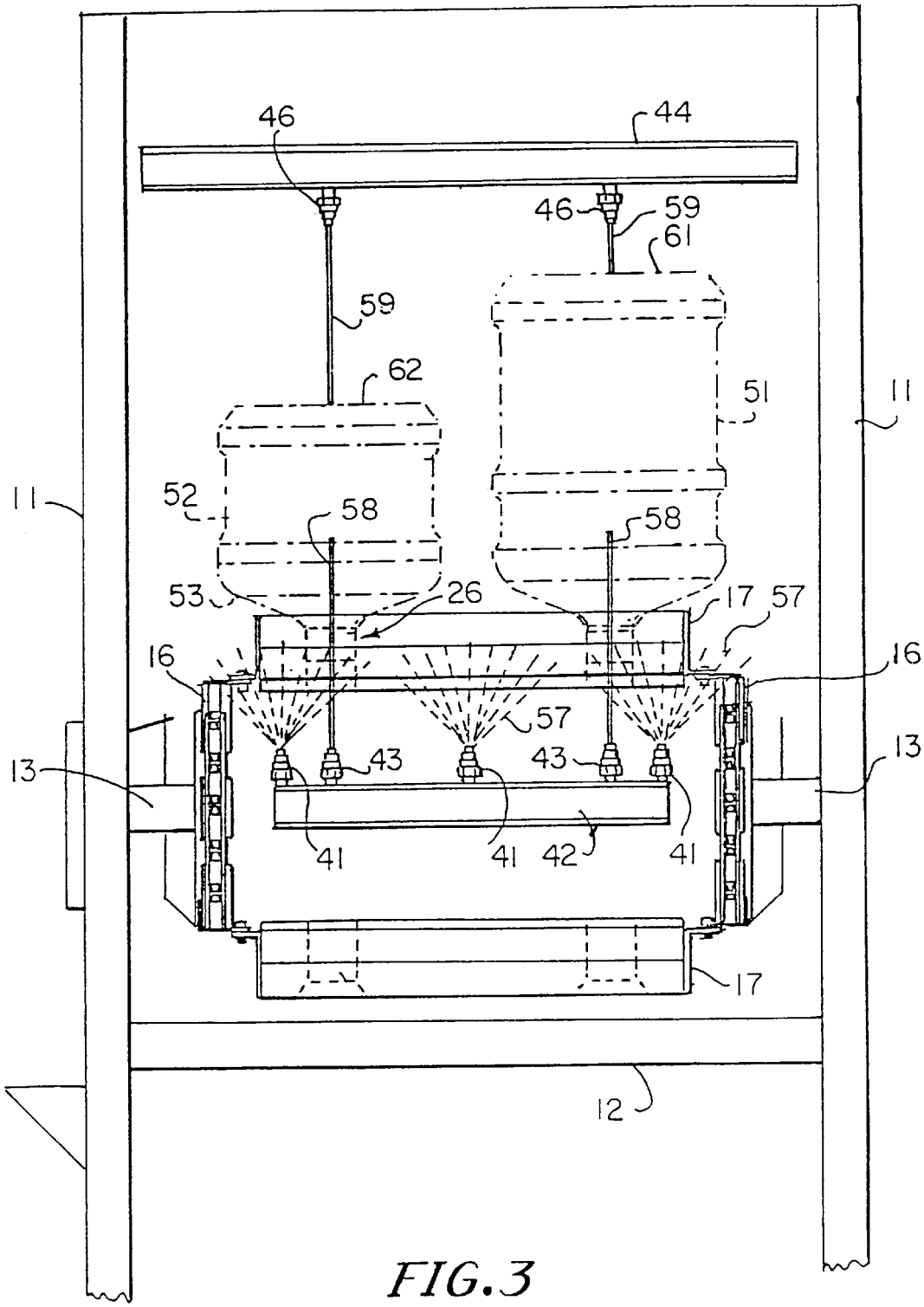
FIG. 3 is a sectional view taken substantially along the line 3—3 of FIG. 1, with certain items omitted for clarity.
Figure 4:
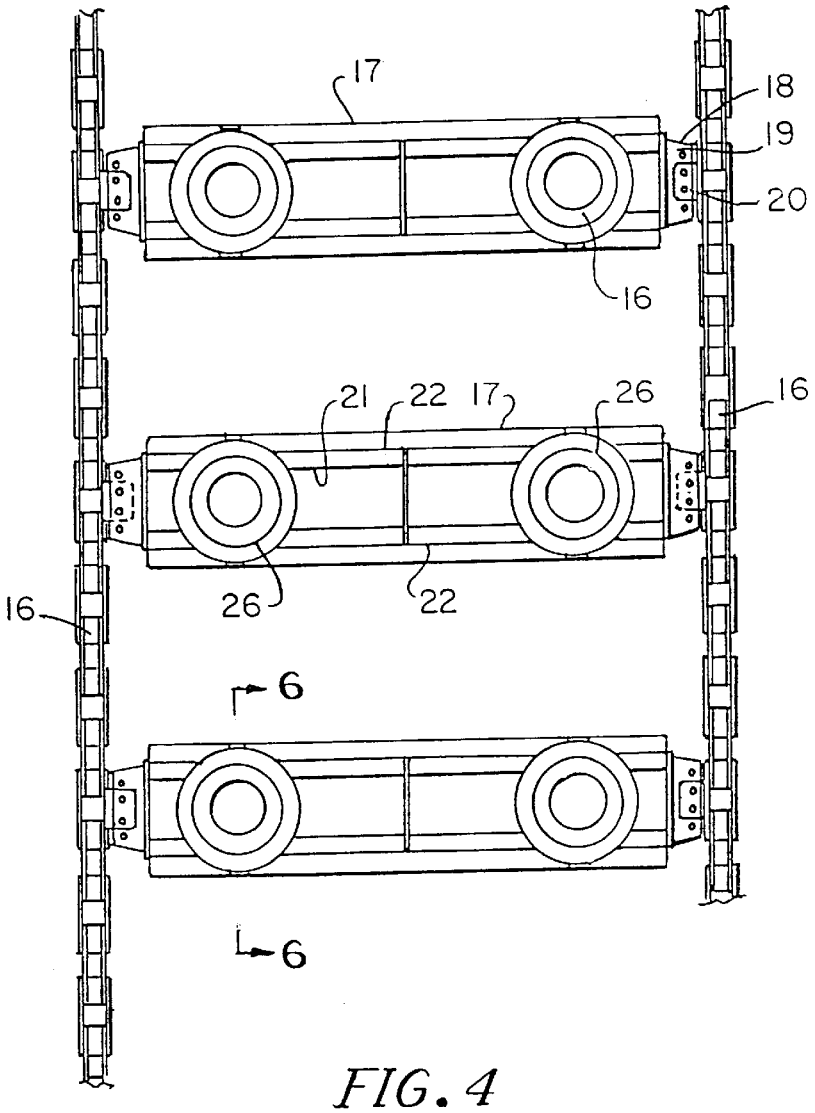
FIG. 4 is an enlarged fragmentary top plan view of a conveyor used to move bottles through the apparatus.
Figure 5:
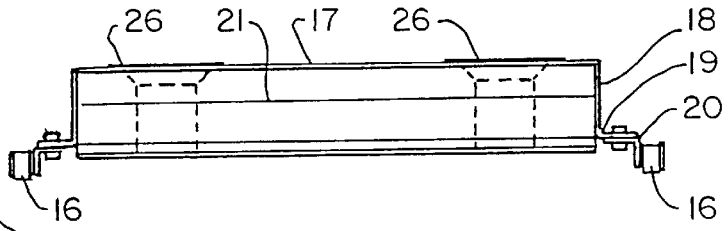
FIG. 5 is an end elevation of one of the carriages of the conveyor.

FIGS. 1–3 show only a portion of the main wash station of the bottle cleaning system. The chain drives 16 move from right to left as viewed in FIG. 1 and preferably move intermittently so that each carriage 17 stops in specific positions during progress of the bottle 51 or 52 from one end to the other. It will be understood that, although there are two bottles shown in side-by-side position in FIGS. 2 and 3, the number of such bottles may be reduced to one or increased to a considerable number such as ten, depending on the size of the equipment needed to satisfy the requirements of the bottling works.

Top and bottom longitudinal headers 36 receive the recycled main washing solution from the collection tank (not shown), pressurized by the pump (not shown). At the top of the system are transverse top spray pipes 37, preferably one between each position. Inserted at appropriate locations in pipe 37 are full cone spray nozzles 38 which spray the outsides of bottles 51 or 52 for the purpose of cleaning as they stop at each position. At the bottom of the machine are transverse bottom pipes 42 into which are mounted at appropriate intervals full cone spray nozzles 41 similar to nozzles 38 to spray bottle exteriors.

Also mounted in pipes 42 between nozzles 41 and in a position directly under the holders 26 when they stop at a particular position are solid stream bottom jet nozzles 43 also connected to pipes 42 which direct jets 58 into the open necks of the bottles and clean the bottles by impinging upon the bottoms thereof and running down the sides and shoulders to thoroughly wash any contaminant or debris which may be in the bottles. Pressure ranges for pipe 42 heretofore have been from 20–35 psi for 5 gallon bottles and for 3 gallon bottles. The use of such bottom jet nozzles 43 is common in bottle cleaning apparatus heretofore in the prior art. With the increasing search for lighter weight bottles 51, 52 and the demand for higher pressure in the jet nozzles 43, there has been a tendency for the bottles 51, 52 to lift out of the holders 26. Mechanical clamp-down devices have not been satisfactory. Among the reasons for the failure of such clamps is the fact that a cleaning line may at different times handle bottles 51, 52 of different capacities. Further, the bottle varies in details of construction so that the height of the bottom 61, 62 of the bottle from the holders 26 * varies and the profile of the neck 54 varies in details of construction making it difficult to grip with the holder 26.

In order to overcome the tendencies of bottles to be lifted off the conveyor holder 26, in accordance with the present invention top transverse pipes 44 are located above pipes 42. Solid stream top jet nozzles 46 are installed in pipes 44 above the nozzles 43. Pipes 44 may receive the same or a different fluid than pipes 42 and may be at the same or different pressures. A smaller orifice and flow rate can be used on the top jet nozzles 46 as compared with nozzles 43. Pipes 42 may then be at higher pressures than heretofore, such as 40–80 psi, or more and at a nozzle flow rate of 3 to 7 gallons per minute.

Thus as the bottles pass along the conveyor chains 16 through the main wash area they are at several positions within the main wash station subjected to external top sprays 56 and bottom sprays 57. The purpose for these sprays 56 is to clean the exterior of the bottle, and not to hold down the bottles. In addition, the interior of the bottle is cleaned by bottom jet sprays 58 which are directed through the open necks at the bottom of the bottle. Top jets 59 from nozzles 46 are directed against the bottoms 61, 62 to counteract the force of the jets 58 which tend to lift the bottles off the conveyor.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A method of cleaning a bottle having an open neck at one end and a bottom opposite said one end comprising supporting said bottle in an inverted position, directing a stream of a first fluid under pressure into said open neck to clean the interior of said bottle, and directing a stream of second fluid under pressure against said bottom to counterbalance the force of said stream of said first fluid, and directing a spray of said first fluid upward against said one end to clean the exterior of said bottle adjacent said open neck.

2. The method of claim 1 which further comprises spraying said first fluid on the exterior of said bottom of said bottle.

3. The method of claim 2 which further comprises advancing said bottle along a horizontal stretch from position to position and directing a stream of first fluid and directing a stream of second fluid at each said position.

4. The method of claim 1 in which said first and second fluids are detergent solution.

5. The method of claim 4 which further comprises spraying said detergent solution on the exterior of said bottle.

6. The method of claim 1 in which the combined forces of pressure and flow rate of said stream of first fluid is less than the combined forces of the weight of the bottle and the pressure and flow rate of said stream of second fluid.

7. The method of claim 6 in which said stream of first fluid is in a range of 40–80 psi and has a flow rate in a range of 3–7 gallons per minute.

8. A method of cleaning a bottle having an open and narrow neck at one end of said bottle and a bottom opposite said one end, said method comprising the steps of:

while supporting said bottle in inverted position stationary at a first position, directing a first jet stream of fluid upward directly into said open neck to clean the interior of said bottle;

directing a second jet stream of fluid downward against said bottom to counterbalance the force of said first stream of fluid; and directing a spray of fluid to clean the exterior of the bottle adjacent said narrow neck, in which said directing a spray of fluid step is accomplished by spraying fluid upward in a third stream on the exterior of said bottle from a source separate from said first stream of fluid.

9. The method of claim 8 in which said third stream comprises a spray of detergent solution sprayed on the exterior of said bottle.

10. The method of claim 8 in which said first and second streams comprise detergent solution.

11. The method of claim 8 which further comprises the step of intermittently advancing said bottle along a horizontal stretch from stationary position to stationary position including said first position and directing at said bottle a first stream of fluid upward and directing at said bottle a second stream of fluid downward at each said position.

12. The method of claim 8 in which the upward force resulting from the combination of pressure and flow rate of said first stream of fluid is less than the combined downward force resulting from the weight of the bottle and the pressure and flow rate of said second stream of fluid.

13. The method of claim 12 in which said first stream of fluid is in a range of 40–80 psi and a flow rate in a range of 3–7 gallons per minute.

14. The method of claim 8 in which said second stream is directed transversely to said bottom and has a cross-sectional area of impingement less than the surface area of said bottom.

* * * * *